US009341404B2

(12) United States Patent
Lee

(10) Patent No.: US 9,341,404 B2
(45) Date of Patent: May 17, 2016

(54) REFRIGERATOR HAVING A DETACHABLE WATER SUPPLY ASSEMBLY

(75) Inventor: Seunggeun Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 414 days.

(21) Appl. No.: 13/704,298

(22) PCT Filed: Jun. 22, 2011

(86) PCT No.: PCT/KR2011/004572

§ 371 (c)(1),
(2), (4) Date: Apr. 29, 2013

(87) PCT Pub. No.: WO2011/162550

PCT Pub. Date: Dec. 29, 2011

(65) Prior Publication Data

US 2013/0283844 A1 Oct. 31, 2013

(30) Foreign Application Priority Data

Jun. 22, 2010 (KR) ..... 10-2010-0058862

(51) Int. Cl.
*F25D 3/00* (2006.01)
*F25D 19/00* (2006.01)
(Continued)

(52) U.S. Cl.
CPC ..... *F25D 11/00* (2013.01); *F25D 23/028* (2013.01); *F25D 23/126* (2013.01); *F25D 2323/122* (2013.01)

(58) Field of Classification Search
CPC ..... F25D 2323/122; F25D 23/126; F25D 23/028; F25D 11/00; Y10T 403/59; Y10T 403/591; Y10T 403/595
USPC ..... 62/389, 340, 449, 391, 397, 338, 377; 222/288, 325, 153.04
See application file for complete search history.

(56) References Cited

U.S. PATENT DOCUMENTS 1,460,208 A * 6/1923 Mohn ..... 222/398
1,966,648 A * 7/1934 Ryberg ..... 222/183
(Continued)

FOREIGN PATENT DOCUMENTS

CN 1199457 A 11/1998
CN 2539113 Y 3/2003
(Continued)

OTHER PUBLICATIONS

Chinese Office Action dated Jul. 31, 2014 for Chinese Application No. 201180031072.7, with English Translation, 11 pages.
(Continued)

*Primary Examiner* — Emmanuel Duke
*Assistant Examiner* — Joseph Trpisovsky
(74) *Attorney, Agent, or Firm* — Fish & Richardson P.C.

(57) ABSTRACT

Provided is a refrigerator. The refrigerator includes a cabinet providing a storage chamber closed by a door, a water supply container disposed at the door or the storage chamber to store water to be supplied to an icemaker or a dispenser, a detachable container connection assembly disposed at an upper side of the water supply container, a housing disposed at the door or the storage chamber so that the container connection assembly can be detachably attached to the housing, and a manipulation unit disposed at the container connection assembly to lock or unlock the container connection assembly attached to the housing. Therefore, the refrigerator can be conveniently used.

5 Claims, 8 Drawing Sheets

(51) Int. Cl.

| | |
|---|---|
| ***F25D 23/12*** | (2006.01) |
| ***F25D 25/00*** | (2006.01) |
| ***F25C 1/22*** | (2006.01) |
| ***F25D 11/00*** | (2006.01) |
| ***F25D 23/02*** | (2006.01) |

(56) References Cited

U.S. PATENT DOCUMENTS

| | | | | |
|---|---|---|---|---|
| 2,255,280 | A * | 9/1941 | Colvin | 312/322 |
| 2,274,409 | A * | 2/1942 | Harbison | 222/183 |
| 3,208,641 | A * | 9/1965 | Brugioni | 222/108 |
| 6,056,157 | A * | 5/2000 | Gehl et al. | 222/94 |
| 7,231,782 | B2 | 6/2007 | Jung | |
| 7,240,397 | B2 | 7/2007 | Han | |
| 7,418,831 | B2 | 9/2008 | Bowen et al. | |
| 2006/0144074 | A1 | 7/2006 | Bowen et al. | |
| 2010/0077789 | A1 * | 4/2010 | Lim et al. | 62/344 |

FOREIGN PATENT DOCUMENTS

| | | | |
|---|---|---|---|
| WO | WO 98/09119 | A1 | 3/1998 |
| WO | WO 2009/061118 | A2 | 5/2009 |

OTHER PUBLICATIONS

International Search Report dated Feb. 10, 2012 for Application No. PCT/KR2011/004572, 2 pages.

* cited by examiner

REFRIGERATOR HAVING A DETACHABLE WATER SUPPLY ASSEMBLY

CROSS REFERENCE TO RELATED APPLICATIONS

This application is a U.S. National Phase Application under 35 U.S.C. §371 of International Application PCT/KR2011/004572, filed on Jun. 22, 2011, which claims the benefit of Korean Application No. 10-2010-0058862, filed on Jun. 22, 2010, the prior applications are hereby incorporated by reference in their entireties.

TECHNICAL FIELD

The present disclosure relates to a refrigerator.

BACKGROUND ART

Refrigerators are home appliances for storing foods at a low temperature. For this, refrigerators include storage chambers closed by doors. In the refrigeration cycle of a refrigerator, a refrigerant is changed to a low-temperature and low-pressure state and exchanges heat with air to produce cooling air. The cooling air keeps the storage chamber of the refrigerator at a low temperature so that foods stored in the storage chamber can be kept fresh.

Consumption of large and multifunctional refrigerators have increased with the change of people's eating patterns and preference, and refrigerators having various structures and convenience devices have been introduced in the market.

For example, an ice maker and a dispenser may be included in a refrigerator as convenience devices. The ice maker may be disposed in the refrigerator and the dispenser may be disposed in a door of the refrigerator to provide ice and water to a user.

In general, water is directly supplied to an ice making tray of the ice maker, or after filling water in a water supply container having a capacity for one-time ice making, the water supply container is disposed in the refrigerator to supply water to the ice making tray.

However, in this case, supply of water is necessary after making ice once. If a large water supply container is used, water filled in the large water supply container may freeze before all the water is supplied to the ice making tray, and thus ice may not be continuously made.

Therefore, in a refrigerator proposed to solve the above-mentioned limitations, a water supply line is directly connected to a water pipe of a house to continuously operate an ice maker. In addition, the water supply line is connected to a dispenser of the refrigerator.

In another kind of refrigerator proposed to solve the above-mentioned limitations, water is supplied to an ice maker and a dispenser from a water supply container disposed in the refrigerator through a water supply passage by using a pump.

DISCLOSURE OF INVENTION

Technical Problem

Embodiments provide a convenient refrigerator in which a manipulation unit of a container connection assembly can be handled to lock or unlock the container connection assembly.

Solution to Problem

In one embodiment, a refrigerator includes: a cabinet providing a storage chamber closed by a door; a water supply container disposed at the door or the storage chamber to store water to be supplied to an icemaker or a dispenser; a detachable container connection assembly disposed at an upper side of the water supply container; a housing disposed at the door or the storage chamber, the container connection assembly being detachably attached to the housing; and a manipulation unit disposed at the container connection assembly to lock or unlock the container connection assembly attached to the housing.

Advantageous Effects of Invention

According to embodiments, in a state where the container connection assembly coupled with the water supply container is attached to the housing, the manipulation unit of the container connection assembly can be handled to lock or unlock the container connection assembly.

Therefore, when the water supply container is attached to a refrigerator door of the refrigerator, although the refrigerator door is rotated or impacted, the water supply container is not freely detached.

The water supply container can be detached by unlocking the container connection assembly using the manipulation unit and separating the container connection assembly from the housing.

Since the container connection assembly can be easily locked and unlocked by using the manipulation unit of the container connection assembly, the refrigerator can be conveniently used.

In addition, upper and lower ends of a vertically movable suction passage of the container connection assembly are supported by elastic members so that the suction passage can be positioned at an original center position after an external force is removed. Therefore, the container connection assembly can be easily and conveniently attached and detached.

MODE FOR THE INVENTION

Reference will now be made in detail to embodiments of the present disclosure, examples of which are illustrated in the accompanying drawings. The present disclosure may, however, be embodied in many different forms and should not be construed as being limited to the embodiments set forth herein.

In the following descriptions of embodiments, a side-by-side refrigerator having freezer and refrigerator compartments at left and right sides is described as an example. However, the inventive concept of the present disclosure is not limited thereto but can be applied to any other refrigerators having a water supply container configured to supply water to an icemaker or a dispenser.

Figure 1:
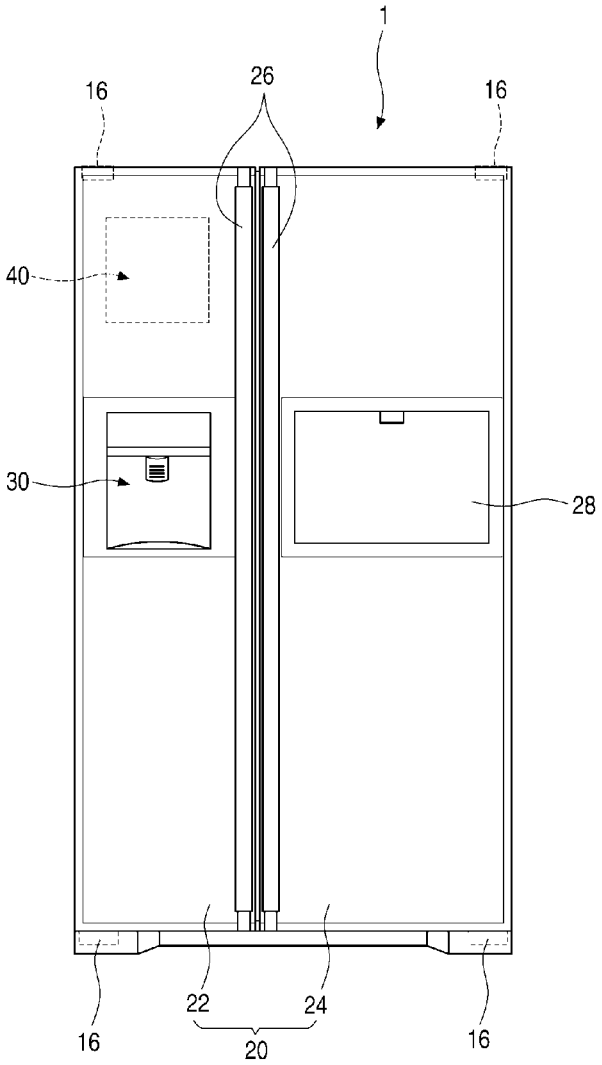
FIG. 1 is a front view illustrating a refrigerator according to an embodiment.
Figure 2:
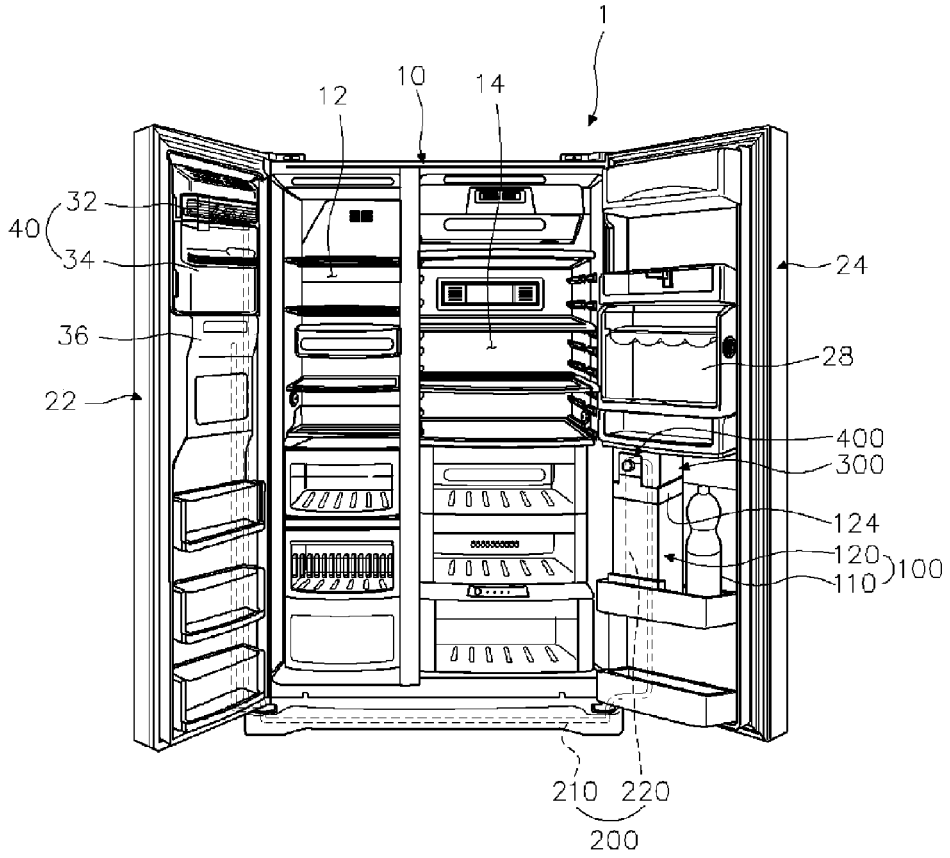
FIG. 2 is a front view illustrating the refrigerator when doors of the refrigerator are opened.

FIG. 1 is a front view illustrating a refrigerator 1 according to an embodiment. FIG. 2 is a front view illustrating the refrigerator 1 when doors 20 of the refrigerator 1 are opened.

Referring to FIGS. 1 and 2, the refrigerator 1 of the current embodiment includes a cabinet 10 in which a storage chamber is formed, and the doors 20 used to close and open the storage chamber.

The front side of the cabinet 10 is opened, and the inside of the cabinet 10 is divided into left and right parts: a freezer compartment 12 and a refrigerator compartment 14. A plurality of racks and drawers are disposed in the freezer compartment 12 and the refrigerator compartment 14 to store foods.

The doors 20 include a freezer compartment door 22 and a refrigerator compartment door 24 for closing and opening the freezer compartment 12 and the refrigerator compartment 14. The doors 20 are rotatably coupled to the cabinet 10 using hinges 16. Therefore, the refrigerator compartment 14 and the freezer compartment 12 can be closed or opened by rotating the refrigerator compartment door 24 and the freezer compartment door 22.

Door handles 26 are provided on the refrigerator compartment door 24 and the freezer compartment door 22. A home bar 28 may be disposed in the refrigerator compartment door 24. In addition, a dispenser 30 and an ice maker assembly 40 may be disposed in the freezer compartment door 22, and water may be supplied to the dispenser 30 and the ice maker assembly 40.

In detail, the dispenser 30 may be disposed on the front side of the freezer compartment door 22 so that a user can take water or ice from the dispenser 30. The ice maker assembly 40 may be disposed on the rear side of the freezer compartment door 22. The ice maker assembly 40 may be disposed above the dispenser 30 to make ice using water supplied from a water supply container 100 (described later).

According to the kind of the refrigerator 1, the dispenser 30 may be disposed in the refrigerator compartment door 24, and the ice maker assembly 40 may be disposed at an inner position of the freezer compartment 12. The following descriptions are given of the case where the dispenser 30 and the ice maker assembly 40 are disposed at the freezer compartment door 22.

The ice maker assembly 40 includes an icemaker 32 configured to make ice by freezing supplied water and an ice bank 34 disposed under the icemaker 32 to store ice.

Water is automatically supplied to the icemaker 32, and then the water freezes into ice in the icemaker 32 by cooling air supplied from the freezer compartment 12. The ice is automatically transferred from the icemaker 32 to the ice bank 34. The icemaker 32 may have the same structure as an icemaker of the related art.

Ice made by the icemaker 32 is stored in the ice bank 34. The ice may be supplied to the dispenser 30 from the ice bank 34 through an ice chute 36 by manipulating the dispenser 30.

The water supply container 100 is disposed on the rear side of the refrigerator compartment door 24. The water supply container 100 may store ice-making water and/or drinking water that will be supplied to the icemaker 32 and/or the dispenser 30. Water may be filled in the water supply container 100 after detaching the water supply container 100 from the refrigerator compartment door 24.

The water supply container 100 is detachably attached to the refrigerator compartment door 24 in a state where the water supply container 100 is connected to a container connection assembly 400 (described below). A dedicated container designed to be connected to the container connection assembly 400 may be used as the water supply container 100. Alternatively, a mineral water bottle available on the market may be used as the water supply container 100. For this, the container connection assembly 400 is designed to be attached to both a dedicated container and a mineral water bottle.

A plurality of baskets are disposed on the rear side of the refrigerator compartment door 24. The heights of the baskets may be adjusted by detaching the baskets and attaching the baskets to other positions. The water supply container 100 may be supported on one of the baskets.

Water may be supplied from the water supply container 100 to the icemaker 32 and the dispenser 30 through a flow passage 200 constituted by a water supply passage 210 and a suction passage 220. The flow passage 200 may be variously changed according to the positions of the water supply container 100, the icemaker 32, and the dispenser 30. The flow passage 200 may extend in the cabinet 10 and the doors 20 through the hinges 16 connected between the cabinet 10 and the doors 20.

Figure 3:
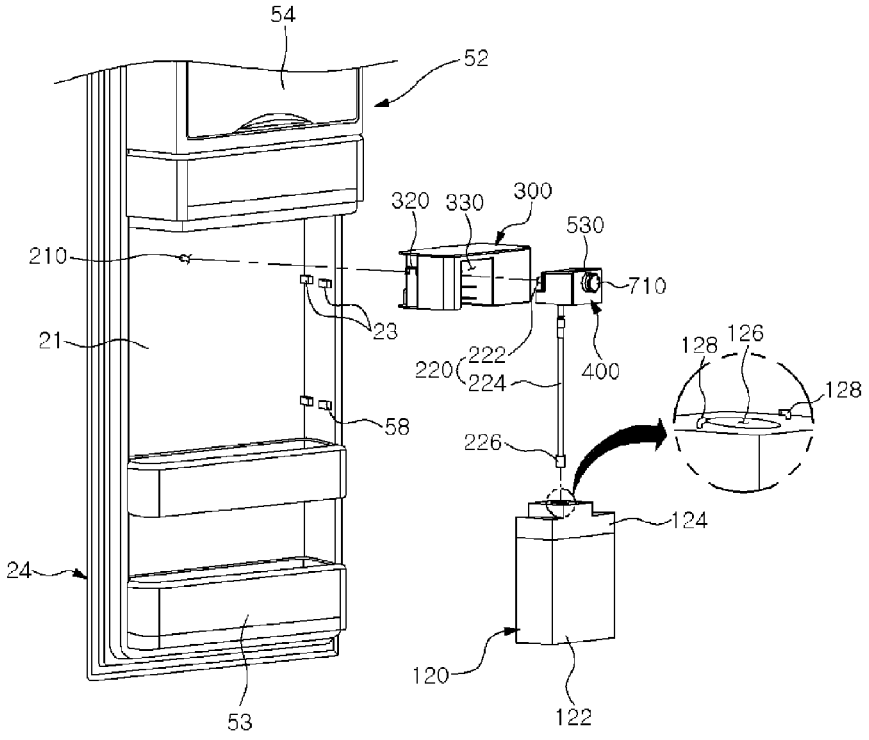
FIG. 3 is an exploded perspective view for illustrating how a door, a housing, and a container connection assembly are coupled according to an embodiment.
Figure 4:
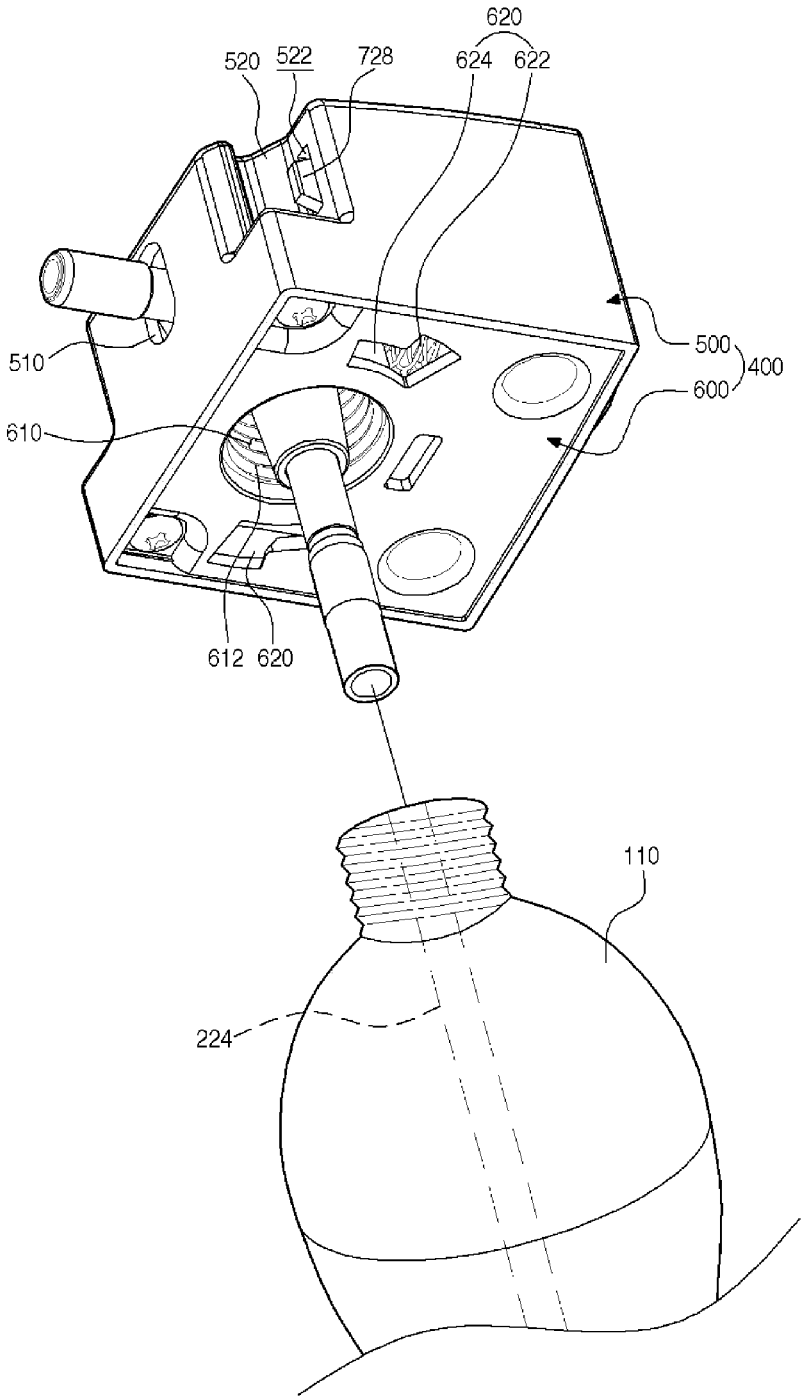
FIG. 4 is an exploded perspective view for illustrating how the container connection assembly is coupled with a water supply container according to an embodiment.

FIG. 3 is an exploded perspective view for illustrating how the door 24, the container connection assembly 400, and a housing 300 are coupled according to an embodiment. FIG. 4 is an exploded perspective view for illustrating how the container connection assembly 400 is coupled with the water supply container 100 according to an embodiment.

Referring to FIGS. 3 and 4, the housing 300 is attached to the rear side of the refrigerator compartment door 24. The container connection assembly 400 connected to the water supply container 100 is detachably attached to the housing 300. A pump may be disposed in the housing 300 for pumping water out of the water supply container 100. A side of the water supply passage 210 is exposed through the housing 300, and when the container connection assembly 400 is attached to the housing 300, the suction passage 220 may be connected to the water supply passage 210.

When a door liner 21 is formed or disposed on the rear side of the refrigerator compartment door 24, the housing 300 may formed in one piece with the door liner 21. Alternatively, the housing 300 may be separately fabricated and then attached to the door liner 21. In the latter case, mounting parts 320 are disposed on both sides of the housing 300 so that the housing 300 can be coupled to receiving protrusions 23 of the door liner 21. If the housing 300 is unnecessary, a basket can be coupled to the receiving protrusions 23.

The housing 300 includes a pump accommodation part 310 (refer to FIG. 8) and a receiving part 330. The rear side of the pump accommodation part 310 is opened so that the pump can be disposed in the pump accommodation part 310 through the opened rear side of the pump accommodation part 310. The receiving part 330 is disposed at a side of the pump accommodation part 310.

The container connection assembly 400 is disposed in the receiving part 330. For this, the receiving part 330 has a recess shape and size corresponding to the container connection assembly 400. A flow passage insertion hole 332 (refer to FIG. 8) is formed approximately at the center of the receiving part 330. A connection tube 222 of the container connection assembly 400 is inserted in the flow passage insertion hole 332 and is connected to an end of the water supply passage 210 extending from the icemaker 32 or the dispenser 30.

That is, when the container connection assembly 400 is mounted, the suction passage 220 protruding from the container connection assembly 400 may be connected to the water supply passage 210 through the flow passage insertion hole 332. A sealing member 334 may be disposed at the flow passage insertion hole 332 so that the water supply passage 210 and the connection tube 222 can be hermetically coupled.

Container fixing members 340 (refer to FIG. 8) are disposed at left and right sides of the flow passage insertion hole 332. When the container connection assembly 400 is mounted, the container fixing members 340 are coupled to restraints 520 of the container connection assembly 400 to fix the container connection assembly 400.

Figure 8:
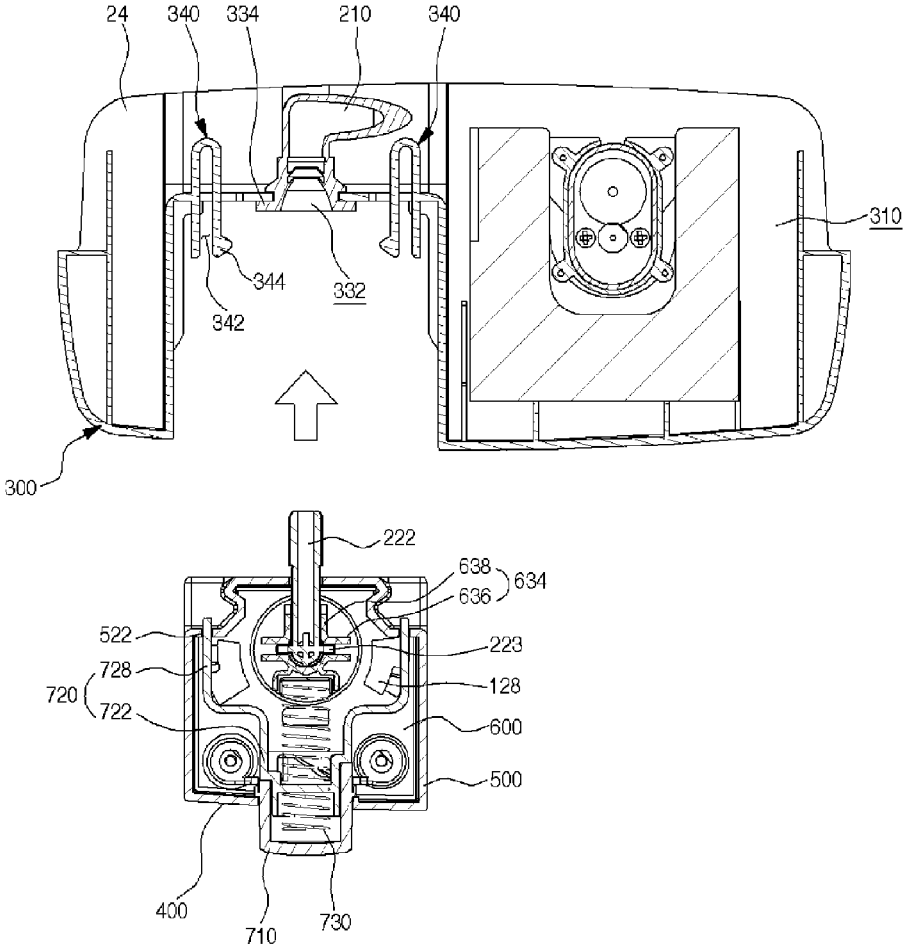
FIGS. 8 to 10 are views for illustrating how the container connection assembly is coupled to the housing according to an embodiment.

Referring to FIG. 8, the container fixing members 340 extend into the housing 300 and are bent to the outside of the housing 300. Slider accommodation regions 342 are formed at the bent portions of the container fixing members 340 to accommodate portions of restraining members 720 (refer to FIG. 6). Hook-shaped fixing protrusions 344 are formed on outwardly extending ends of the container fixing members 340. When the container connection assembly 400 is coupled, the fixing protrusions 344 are inserted and caught in the restraints 520.

The container connection assembly 400 has a hexahedral shape corresponding to the receiving part 330. A manipulation member 710 is disposed at the front side of the container connection assembly 400. The manipulation member 710 is described later in detail. The connection tube 222 extends outward from a center portion of the rear side of the container connection assembly 400, and both lateral corners of the container connection assembly 400 are recessed to form the restraints 520.

The restraints 520 may have a shape corresponding to the shape of the fixing protrusions 344 of the container fixing members 340 so that the fixing protrusions 344 can be caught in the restraints 520. In addition, the restraints 520 may be vertically long so that the container connection assembly 400 can be vertically moved in a state where the fixing protrusions 344 are coupled to the restraints 520.

A suction tube 224 (refer to FIGS. 3 and 4) extends downward from the container connection assembly 400. The suction tube 224 may be inserted in the water supply container 100. A filter member 226 may be disposed on the lower end of the suction tube 224 to filter water.

The water supply container 100 may include a main water supply container 110 such as a mineral water bottle available on the market, and a sub water supply container 120 dedicated for coupling with the container connection assembly 400.

In detail, as shown in FIG. 4, the main water supply container 110 may be a mineral water plastic or glass bottle having a mouth on its topside and available on the market. That is, any one of various mineral water bottles having a threaded mount may be used as the main water supply container 110. The thread mouth may be coupled to the container connection assembly 400. For example, a mineral water bottle may be directly coupled to the container connection assembly 400 after removing a cap from the mineral water bottle.

The sub water supply container 120 may be larger than the main water supply container 110. The sub water supply container 120 may have a proper size according to the size of a basket where the water supply container 100 is disposed and the height of the container connection assembly 400.

The sub water supply container 120 includes: a container main body 122 configured to contain water and having an opened topside; and a container cover 124 configured to close at least a portion of the opened topside of the container main body 122. The container cover 124 includes an opening 126 for supplying or receiving water, and container coupling protrusions 128 disposed at both sides of the opening 126.

The container coupling protrusions 128 have a shape corresponding to the shape of a container coupling holes 620 (described later) so that the sub water supply container 120 can be fixed to the bottom side of the container connection assembly 400.

The container connection assembly 400 will now be described in more detail with reference to the accompanying drawings.

Figure 5:
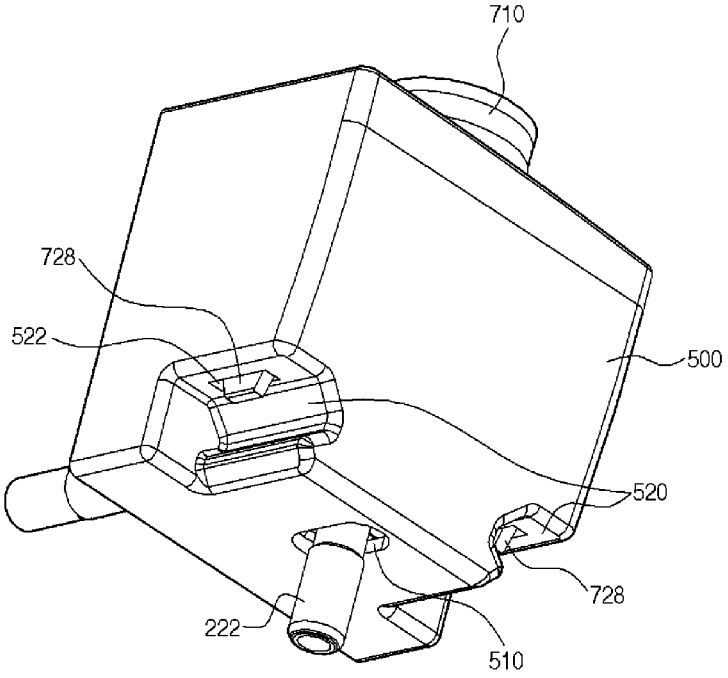
FIG. 5 is a rear perspective view illustrating the container connection assembly according to an embodiment.
Figure 6:
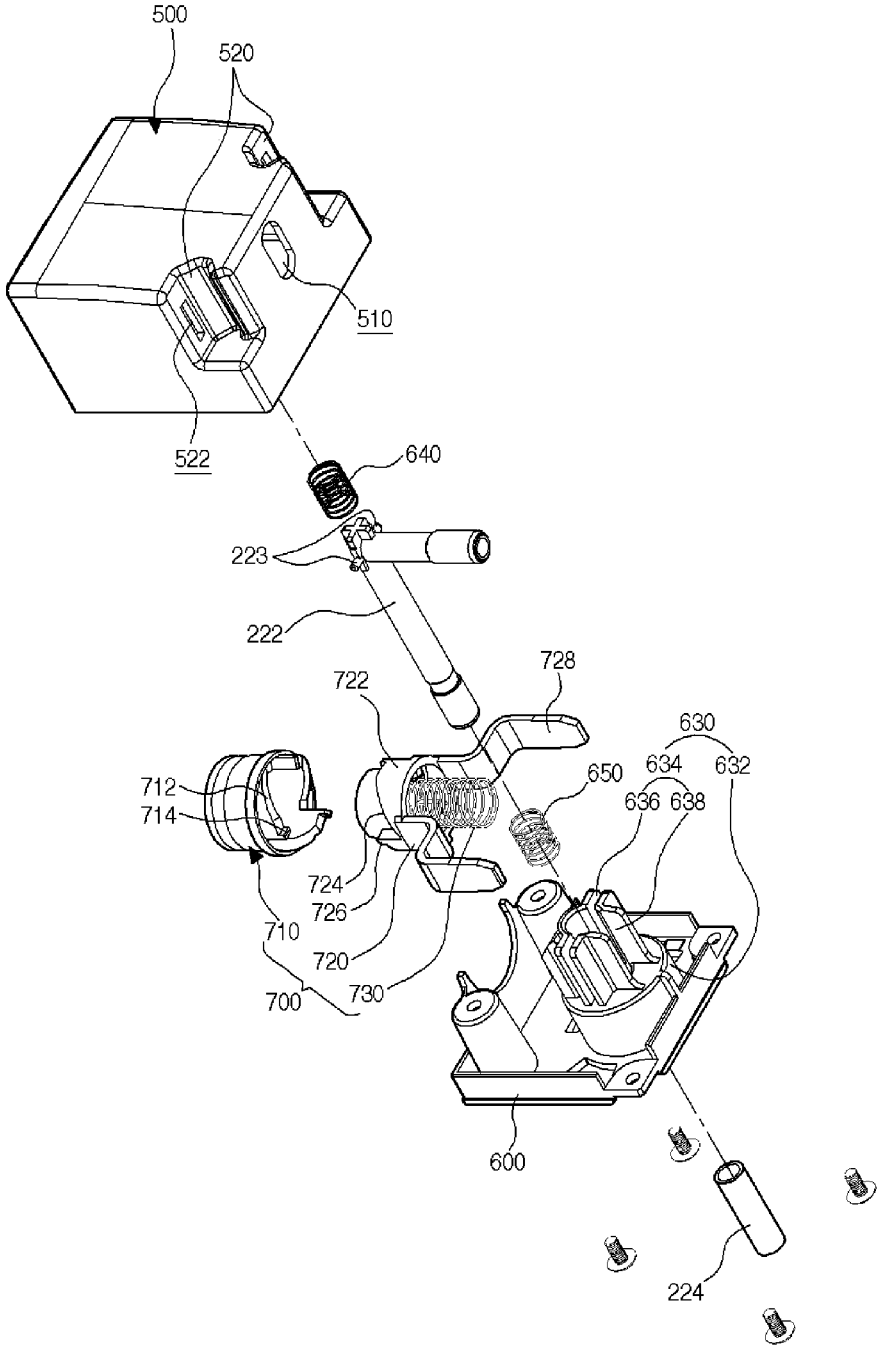
FIG. 6 is an exploded perspective view illustrating the container connection assembly according to an embodiment.
Figure 7:
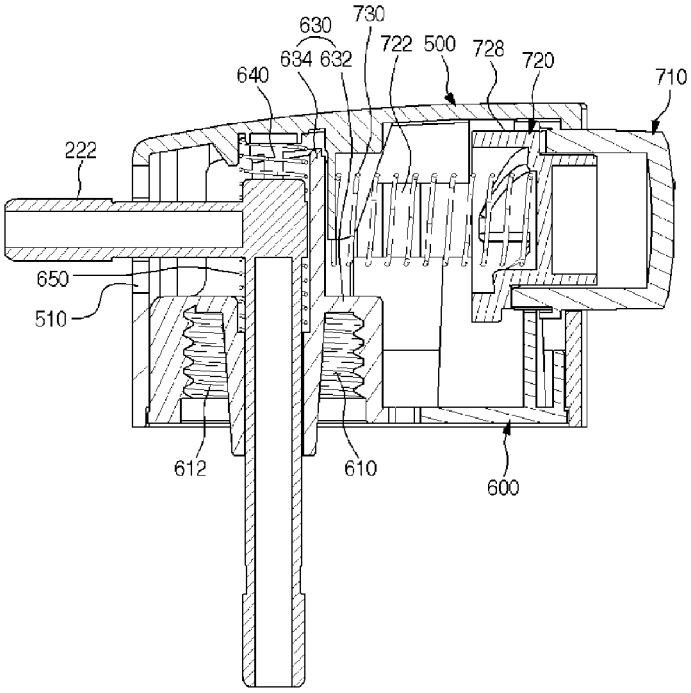
FIG. 7 is a vertical sectional view illustrating the container connection assembly according to an embodiment.

FIG. 5 is a rear perspective view illustrating the container connection assembly 400 according to an embodiment. FIG. 6 is an exploded perspective view illustrating the container connection assembly 400 according to an embodiment. FIG. 7 is a vertical sectional view illustrating the container connection assembly 400 according to an embodiment.

Referring to FIGS. 5 to 7, the container connection assembly 400 includes a case 500 having an opened bottom side, and a bottom plate 600 configured to close the opened bottom side of the case 500.

A penetration hole 510 is formed through a center portion of the rear side of the case 500 to receive the connection tube 222. The penetration hole 510 is vertically long so that the case 500 can be vertically moved in a state where the connection tube 222 is inserted in the flow passage insertion hole 332 of the housing 300.

The restraints 520 are formed by recessing both lateral corners of the rear side of the case 500. The topsides of the restraints 520 are opened so that the container fixing members 340 can be coupled to the restraints 520 by vertically sliding the container fixing members 340 on the restraints 520 as well as by press fitting the container fixing members 340 to the restraints 520 in a forward direction.

Slider holes 522 are formed at the restraints 520 so that ends of the restraining members 720 can be inserted in the slider holes 522. The slider holes 522 are formed at positions corresponding to the slider accommodation regions 342 of the housing 300. The ends of the restraining members 720 protrude from the slider holes 522 and inserted into the slider accommodation regions 342.

A container insertion hole 610 is formed approximately at the center of the bottom plate 600. The container insertion hole 610 is formed to insert a mouth of the water supply container 100 to the container insertion hole 610. A thread 612 is formed on an inner surface of the container insertion hole 610 so that a threaded mouth of the main water supply container 110 (mineral water bottle) can be fixed to the container insertion hole 610. Thus, the main water supply container 110 can be fixed to the container insertion hole 610 by inserting the mouth of the main water supply container 110 into the container insertion hole 610 while rotating the main water supply container 110.

The opening 126 of the sub water supply container 120 has a shape corresponding to the shape of the container insertion hole 610, and when the sub water supply container 120 is attached, the opening 126 is matched with the container insertion hole 610.

The container coupling holes 620 are formed at left and right sides of the container insertion hole 610. The container coupling holes 620 are formed at positions corresponding to the container coupling protrusions 128 of the sub water supply container 120 for coupling with the container coupling protrusions 128. Each of the container coupling holes 620 includes an insertion region 622 and a rotation region 624.

The insertion regions 622 have a shape corresponding to a sectional shape of the container coupling protrusions 128 for receiving the container coupling protrusions 128. After the container coupling protrusions 128 are inserted in the container coupling holes 620, rotations of the container coupling protrusions 128 are guided along the rotation regions 624. The rotation regions 624 have a width smaller than the container coupling protrusions 128 so that the container coupling protrusions 128 can be caught in the rotation regions 624. For this, the rotation regions 624 have a predetermined length and curvature so that the sub water supply container 120 can be fixed to a preset position of the container connection assembly 400 by inserting and rotating the container coupling protrusions 128 of the sub water supply container 120 in the container coupling holes 620.

The suction passage 220 is inserted through the container connection assembly 400. The suction passage 220 includes the connection tube 222 and the suction tube 224. Water is taken from the water supply container 100 through the suction tube 224. The connection tube 222 is bent to connect the upper end of the suction tube 224 to the water supply passage 210.

The suction tube 224 and the connection tube 222 may be formed in one piece by using the same material, or the suction tube 224 and the connection tube 222 may be formed of different materials. The connection tube 222 may be formed of plastic and inserted in the water supply passage 210 and the suction tube 224. The length of the suction tube 224 may be adjusted according to the size of the water supply container 100.

Guide protrusions 223 extend perpendicularly from left and right sides of an upper part of the connection tube 222. The guide protrusions 223 prevent rotation or shaking of the suction passage 220 when the suction passage 220 is relatively moved.

A flow passage accommodation part 630 is disposed at an upper side of the container insertion hole 610. The flow passage accommodation part 630 includes: a lower accommodation part 632 to receive the mouth of the water supply container 100; and a flow passage guide part 634 extending from the topside of the lower accommodation part 632 to accommodate and guide the suction passage 220.

The flow passage guide part 634 encloses and supports the suction passage 220 in a manner such that the flow passage guide part 634 can be vertically moved relative to the suction passage 220 in a state where the suction passage 220 is inserted in the flow passage guide part 634 and fixed to the flow passage insertion hole 332 of the housing 300.

For this, the flow passage guide part 634 includes lateral guide parts 636 having opened lateral sides. The lateral guide parts 636 include ribs spaced apart from each other and extending from the top side to the bottom side of the flow passage guide part 634.

The guide protrusions 223 are disposed in the lateral guide parts 636 so that when the case 500 is vertically moved relative to the connection tube 222, rotation of the connection tube 222 can be prevented.

The flow passage guide part 634 further includes a rear guide part 638 having an opened rear side. The rear guide part 638 includes ribs spaced apart from each other and extending vertically. The rear guide part 638 guide a backwardly bent portion of the connection tube 222.

The rear guide part 638 is formed at a position corresponding to the penetration hole 510 and the flow passage insertion hole 332 of the housing 300. If the case 500 is vertically moved after the container connection assembly 400 is mounted, the relative movement of the connection tube 222 caused by the movement of the case 500 is guided along the rear guide part 638.

A first elastic member 640 and a second elastic member 650 are disposed on upper and lower sides of the connection tube 222, respectively. The upper and lower ends of the first elastic member 640 are supported by the upper side of the connection tube 222 and an inner side of the case 500, respectively. In other words, the first elastic member 640 elastically supports the case 500 and the connection tube 222 to urge the suction passage 220 downward relative to the case 500.

The second elastic member 650 is disposed around the downwardly extending portion of the connection tube 222. The upper end of the second elastic member 650 is supported by the connection tube 222, and the lower end of the second elastic member 650 is supported by an inner side of the flow passage guide part 634. That is, the second elastic member 650 elastically supports the case 500 and the connection tube 222 to urge the suction passage 220 upward.

Therefore, the connection tube 222 can be positioned in place by the first and second elastic members 640 and 650. In addition, although the connection tube 222 is moved by an external force, the connection tube 222 can be returned to an original position after the external force is removed.

A manipulation unit 700 is disposed in the case 500. When the container connection assembly 400 is mounted, the locking state of the container connection assembly 400 can be controlled using the manipulation unit 700.

The manipulation unit 700 may include a manipulation member 710, a locking member 720, and an elastic member 730. A user can manipulate the manipulation member 710, and the locking member 720 is moved in association with the manipulation member 710. The elastic member 730 provides an elastic force to return the locking member 720 to an original position.

In detail, the manipulation member 710 has a cylindrical shape and protrudes forward from a manipulation member mounting hole formed in the front side of the case 500. Since the manipulation member 710 protrudes from the front side of the case 500, a user can rotate the manipulation member 710 by holding the manipulation member 710. The manipulation member 710 is hollow, and the rear side of the manipulation member 710 is opened. The rear side of the manipulation member 710 is stepped outward so that the rear side of the manipulation member 710 can be hooked on the rear side of the manipulation member mounting hole of the case 500.

Manipulation member slopes 712 are formed on the rear side of the manipulation member 710. The manipulation member slopes 712 protrude along the edge of the rear side of the manipulation member 710. The manipulation member slopes 712 have a shape corresponding to locking member slopes 724 (described later) and are arranged along the edge of the rear side of the manipulation member 710. Manipulation member stopper protrusions 714 are formed on upper ends of the manipulation member slopes 712 to limit rotation of the manipulation member 710.

The locking member 720 is movable relative to the bottom plate 600 in forward and backward directions. The locking member 720 is disposed at the rear side of the manipulation member 710. The locking member 720 is disposed in contact with the manipulation member 710 so that the locking member 720 can be moved according to manipulation of the manipulation member 710. The locking member 720 includes a body 722 and sliders 728.

The body 722 makes contact with the manipulation member 710 and has a cylindrical shape with a diameter corresponding to the diameter of the manipulation member 710.

The locking member slopes 724 corresponding to the manipulation member slopes 712 are formed along the circumference of the body 722. The locking member slopes 724 are formed at positions corresponding to the manipulation member slopes 712 and are inclined opposite to the manipulation member slopes 712. Locking member stopper protrusions 726 are formed on upper ends of the locking member slopes 724.

Therefore, when the manipulation unit 700 is assembled, the manipulation member stopper protrusions 714 may be placed on the locking member slopes 724, and the locking member stopper protrusions 726 may be placed on the manipulation member slopes 712. If the manipulation member 710 is rotated in this state, the manipulation member stopper protrusions 714 and the locking member stopper protrusions 726 are moved along the locking member slopes 724 and the manipulation member slopes 712, respectively, and thus the locking member 720 can be moved forward or backward. If the manipulation member 710 is rotated by a predetermined angle, the manipulation member stopper protrusions 714 and the locking member stopper protrusions 726 are brought into contact with each other, and thus the manipulation member 710 cannot be rotated anymore. Accordingly, the locking member 720 cannot be moved anymore.

The body 722 of the locking member 720 can be inserted into the manipulation member 710 through the opened rear side of the manipulation member 710 to bring the manipulation member slopes 712 and the locking member slopes 724 into contact with each other.

The rear side of the body 722 of the locking member 720 is opened, and the elastic member 730 is coupled to the opened rear side of the body 722. The elastic member 730 is disposed between the body 722 and the flow passage accommodation part 630. Thus, the elastic member 730 is compressed when the locking member 720 is moved backward. Therefore, the locking member 720 moved backward by manipulation of the manipulation member 710 can be returned to its original position by the resilience of the elastic member 730.

The sliders 728 extend from left and right sides of the body 722. The sliders 728 are bent a plurality of times, and ends of the sliders 728 are located at positions corresponding to the slider holes 522.

The thicknesses of the sliders 728 are corresponding to the slider accommodation regions 342. When the sliders 728 are inserted in the slider accommodation regions 342, the container fixing members 340 cannot be elastically deformed.

If the manipulation member 710 is not manipulated, the sliders 728 are disposed inside the case 500. However, if the locking member 720 is moved backward by manipulation of the manipulation member 710, the sliders 728 protrude backward from the case 500 through the slider holes 522.

Hereinafter, with reference to the accompanying drawings, a detailed explanation will be given on how the water supply container 100 and the container connection assembly 400 are attached to the refrigerator 1 according to embodiments.

Figure 9:
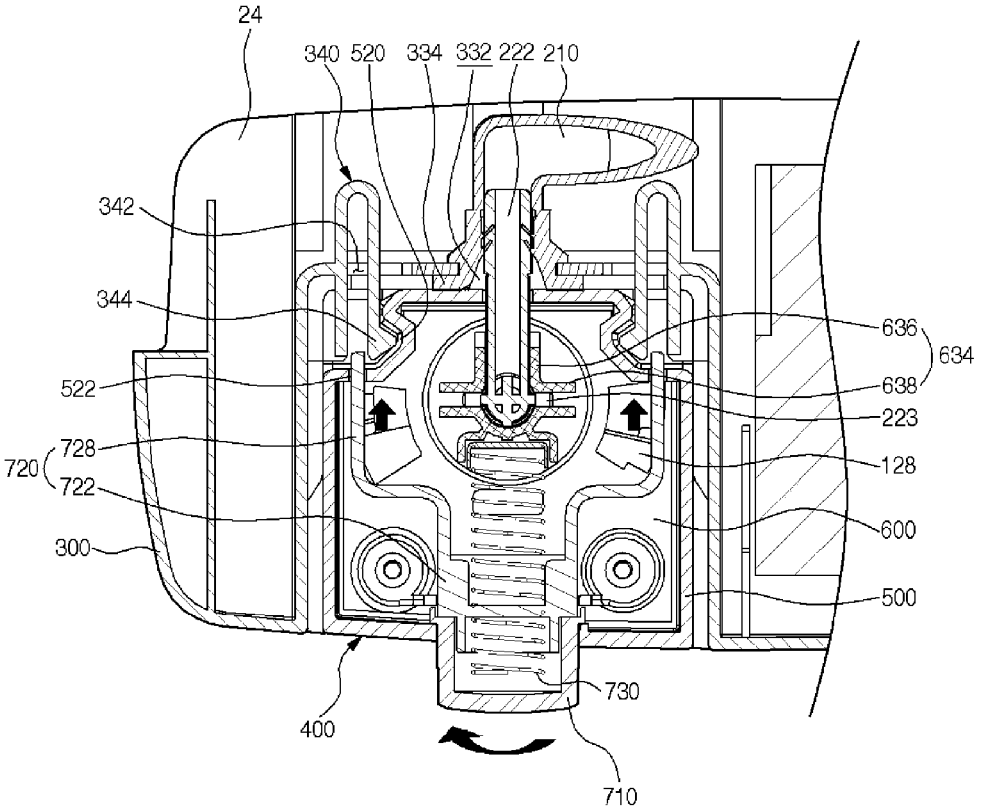
Figure 10:
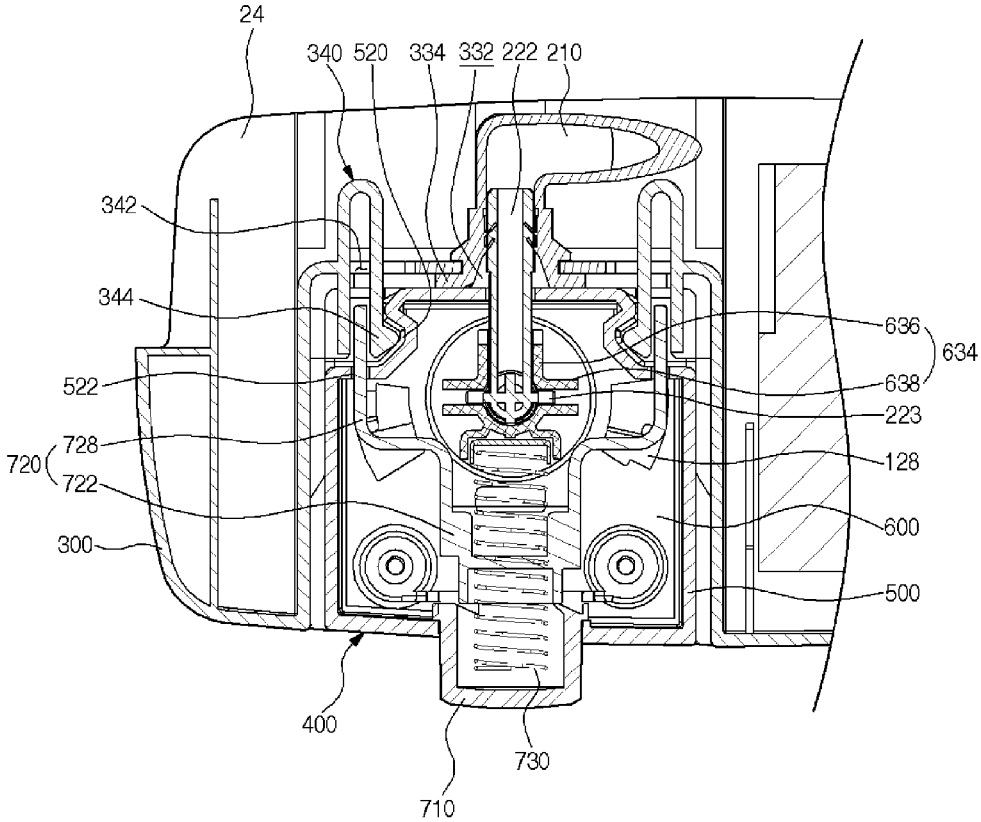

FIGS. 8 to 10 are views for illustrating how the container connection assembly 400 is coupled to the housing 300 according to an embodiment.

Referring to FIGS. 8 to 10, after filling water in the container main body 122 of the water supply container 100, the water supply container 100 is coupled to the container connection assembly 400 so as to attach the water supply container 100 to the rear side of the refrigerator compartment door 24. If a mineral water bottle available on the market is used as the main water supply container 110 of the water supply container 100, filling of water in the mineral water bottle is not necessary. That is, after removing a cap of the mineral water bottle, a threaded mouth of the mineral bottle is inserted in the container insertion hole 610 while rotating the mineral water bottle to fix the mineral water bottle to the container connection assembly 400. If the sub water supply container 120 of the water supply container 100 is used, the container coupling protrusions 128 of the sub water supply container 120 are inserted into the container coupling holes 620 to fix the sub water supply container 120 to the container connection assembly 400.

In the state shown in FIG. 8, the container connection assembly 400 can be attached to the housing 300. In detail, the container connection assembly 400 is brought into contact with the receiving part 330 of the housing 300 to couple the restraints 520 of the container connection assembly 400 to the container fixing members 340 of the housing 300.

At this time, since the container fixing members 340 are elastic, the container fixing members 340 are pushed outward by the restraints 520, and then the fixing protrusions 344 of the container fixing members 340 are caught in the restraints 520 as shown in FIG. 9. In this way, the container connection assembly 400 is attached to the receiving part 330 of the housing 300 by coupling the restraints 520 and the container fixing members 340. In this state, the container connection assembly 400 can be easily detached from the housing 300.

If a user wants more stable coupling between the water supply container 100 and the container connection assembly 400, the manipulation member 710 can be used.

If the manipulation member 710 is rotated after the container connection assembly 400 is completely attached to the housing 300, the manipulation member slopes 712 and the locking member slopes 724 are moved relative to each other while making contact with each other so that the locking member 720 can be moved backward.

Thus, the sliders 728 of the locking member 720 are also moved backward through the slider holes 522. If the manipulation member 710 is fully rotated, the sliders 728 are inserted in the slider accommodation regions 342 of container fixing members 340.

Since the thicknesses of the sliders 728 are corresponding to the slider accommodation regions, the slider accommodation regions 342 are filled with the sliders 728 after the sliders 728 are inserted in the slider accommodation regions 342 as shown in FIG. 10.

Therefore, although forces are applied to the container fixing members 340, the container fixing members 340 are not pushed outward, and thus the fixing protrusions 344 can be held in the restraints 520. In this way, since the fixing protrusions 344 cannot depart from the restraints 520, the container connection assembly 400 can be locked in the housing 300.

In this state, if a user wants to detach the container connection assembly 400 from the housing 300, he/she can rotate the manipulation member 710 in the opposite direction to pull the sliders 728 of the locking member 720 out of the slider accommodation regions 342. After the sliders 728 are taken out of the slider accommodation regions 342, the container connection assembly 400 can be detached from the housing 300 by forwardly pulling the container connection assembly 400.

A detailed explanation will now be given on a relationship between movement of the locking member 720 and rotation of the manipulation member 710.

Figure 11:
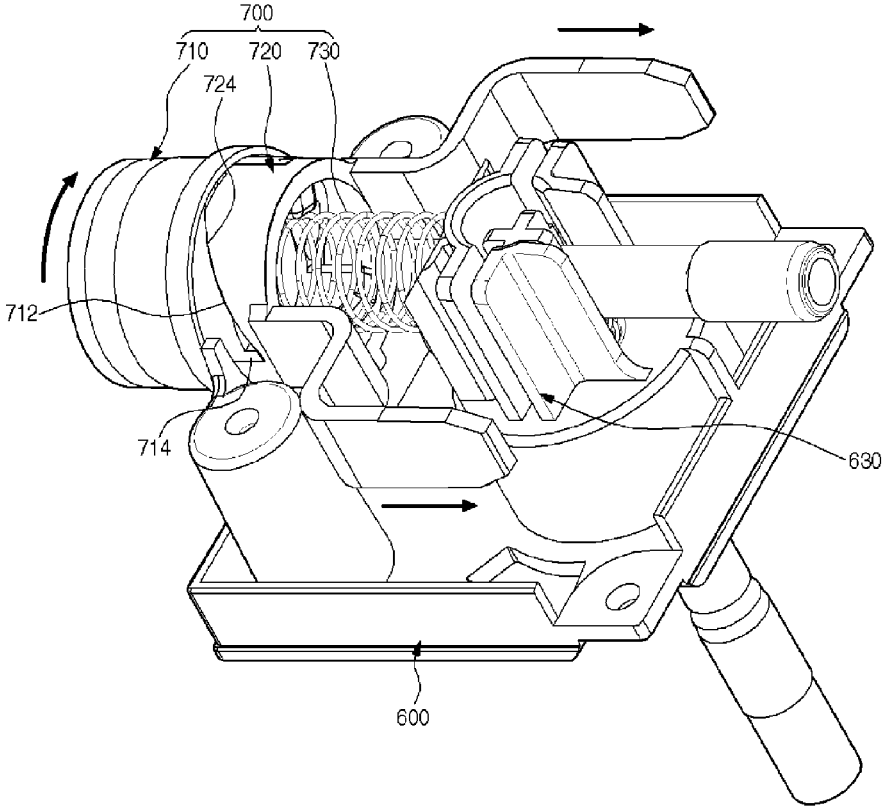
FIGS. 11 and 12 are views illustrating handling of manipulation unit according to an embodiment.
Figure 12:
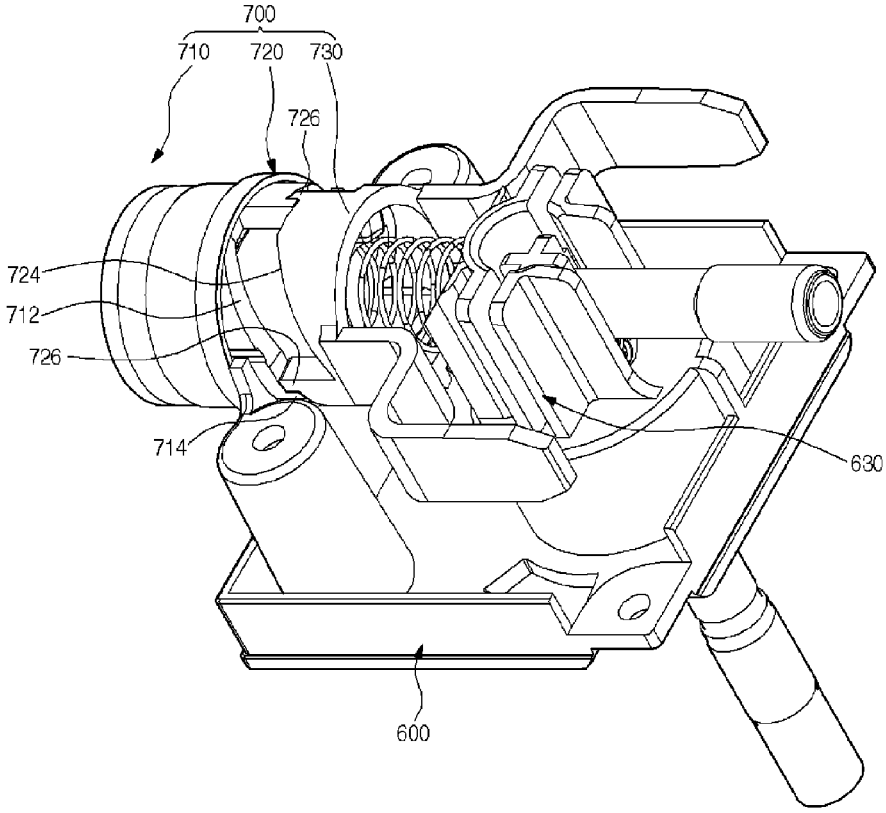

FIGS. 11 and 12 are views illustrating handling of manipulation unit according to an embodiment.

Referring to FIGS. 11 and 12, before the container connection assembly 400 is attached to the housing 300 as shown in FIG. 8 or after the container connection assembly 400 is attached to the housing 300 as show in FIG. 9, the manipulation unit 700 is in a state shown in FIG. 11.

In the state shown in FIG. 11, the locking member 720 of the manipulation unit 700 is at the rearmost position (left in FIG. 11) in the case 500 by the resilience of the elastic member 730. That is, the body 722 of the locking member 720 is in the manipulation member 710.

In addition, the manipulation member slopes 712 and the locking member slopes 724 are closest to each other. That is, the manipulation member slopes 712 and the locking member slopes 724 are in contact with each other. The manipulation member stopper protrusions 714 are at lower positions of the locking member slopes 724, and the locking member stopper protrusions 726 are at lower positions of the manipulation member slopes 712.

In this state, if the manipulation member 710 is rotated counterclockwise, the locking member 720 is moved forward according to the rotation of the manipulation member 710. At this time, the manipulation member stopper protrusions 714 are moved on the locking member slopes 724, and the locking member stopper protrusions 726 are moved on the manipulation member slopes 712.

After the manipulation member 710 is fully rotated counterclockwise, the locking member 720 is at the foremost position as shown in FIG. 10. At this time, the manipulation unit 700 is in the state shown in FIG. 12.

In detail, the manipulation member stopper protrusions 714 are on the upper ends of the locking member slopes 724, and the locking member stopper protrusions 726 are on the upper ends of the manipulation member slopes 712.

In this way, the manipulation member 710 pushes the locking member 720 forward.

At this time, the elastic member 730 is compressed. Thus, if the manipulation member 710 is rotated clockwise, the locking member 720 is moved backward to its original position by the resilience of the elastic member 730.

After the manipulation member 710 is fully rotated, the manipulation member stopper protrusions 714 make interference with the locking member stopper protrusions 726, and thus the manipulation member 710 cannot be further rotated. In addition, after the manipulation member 710 is fully rotated, the manipulation member stopper protrusions 714 are on flat portions of the upper ends of the locking member slopes 724, and the locking member stopper protrusions 726 are on flat portions of the upper ends of the manipulation member slopes 712. Thus, the locking member 720 can be kept at the foremost position.

If the container connection assembly 400 is fixedly attached to the housing 300 after coupling the water supply container 100 to the container connection assembly 400, the suction passage 220 can be connected to the water supply passage 210.

Thus, water can be supplied from the water supply container 100 to the icemaker 32 or the dispenser 30 if the pump is operated according to a user's manipulation.

INDUSTRIAL APPLICABILITY

According to the embodiments, the container connection assembly coupled with the water supply container is attached to the housing, and the housing is attached to the refrigerator compartment door. Therefore, although the refrigerator compartment door is rotated or impacted, the water supply container is not freely detached. Therefore, the water supply container can be stably and conveniently used, and thus the industrial applicability of the refrigerator is high.

The invention claimed is:

1. A refrigerator, comprising:

a cabinet providing a storage chamber closed by a door;

a water supply container disposed at the door or the storage chamber and configured to store water to be supplied to an icemaker or a dispenser;

a housing disposed at the door or the storage chamber, the housing including:

a receiving part, a pump accommodation part adjacent to the receiving part, and a pair of container fixing members located at left and right side edge portions of a rear surface of the receiving part;

a container connection assembly detachably disposed at the receiving part, a top opening of the water supply container configured to be detachably connected to the container connection assembly, the container connection assembly comprising:

a case having a pair of restraints, the restraints being recessed at left and right side edges of a rear end of the case; and a manipulation unit disposed inside the case, the manipulation unit comprising:

a manipulation member passing through a front surface of the case;

a locking member including:

a body to which the manipulation member is rotatably coupled; and a pair of sliders extending from the body and facing each other, the pair of sliders respectively received in slider accommodation regions of the pair of container fixing members; and an elastic member received in the locking member to apply an elastic force to the locking member to return the locking member to an original position;

a suction passage disposed at the container connection assembly, the suction passage comprising:

a connection tube including:

a horizontal part passing through a side surface of the container connection assembly; and a vertical part bent from an end of the horizontal part and passing through a bottom surface of the container connection assembly; and a suction tube connected to an end of the vertical part of the connection tube and extending toward an inside of the water supply container; and a water supply passage disposed inside of the door or the storage chamber, wherein, based on the container connection assembly being attached to the receiving part of the housing to supply water to the icemaker or the dispenser, the water supply passage is configured to be connected to the horizontal part of the connection tube, wherein each container fixing member is configured to horizontally extend in a front-to-rear direction of the housing, and is configured to be bent in a U shape to define a slider accommodation region, wherein both ends of each container fixing member protrude from the rear surface of the receiving part, wherein a fixing protrusion is located at one of both ends of the container fixing member, wherein, based on the case being received in the receiving part, the fixing protrusion is hooked in a restraint, wherein a rear end of the manipulation member and a front end of the body respectively have inclined surfaces which are in close contact to each other, and wherein, based on the manipulation member being rotated in a first direction, the locking member moves in a direction that the elastic member is compressed, and the sliders are inserted in the slider accommodation regions.

2. The refrigerator of claim 1, wherein, based on the manipulation member being rotated in a second direction, the locking member moves in a direction in which the elastic member returns to the original position, and the sliders are withdrawn from the slider accommodation regions.

3. The refrigerator of claim 1, wherein the manipulation member and the body of the locking member have a cylindrical shape.

4. The refrigerator of claim 3, wherein a portion of the manipulation member is configured to protrude forward from a front surface of the case.

5. The refrigerator of claim 1, further comprising elastic members disposed on upper ends of lower sides of the connection tube to urge the suction passage to move upward or downward.

* * * * *